US010139754B2

(12) United States Patent
Morita

(10) Patent No.: US 10,139,754 B2
(45) Date of Patent: Nov. 27, 2018

(54) TONER RECEIVING DEVICE, AND IMAGE FORMING APPARATUS INCLUDING THE SAME

(71) Applicant: KYOCERA Document Solutions Inc., Osaka-shi, Osaka (JP)

(72) Inventor: Takashi Morita, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/875,841

(22) Filed: Jan. 19, 2018

(65) Prior Publication Data

US 2018/0210372 A1 Jul. 26, 2018

(30) Foreign Application Priority Data

Jan. 23, 2017 (JP) ..... 2017-009345

(51) Int. Cl.
*G03G 15/08* (2006.01)

(52) U.S. Cl.
CPC ..... *G03G 15/0886* (2013.01)

(58) Field of Classification Search
CPC ..... G03G 15/0881; G03G 15/0886; G03G 2215/0692
See application file for complete search history.

(56) References Cited

U.S. PATENT DOCUMENTS 6,041,212 A * 3/2000 Okada ..... G03G 15/0822 399/359
8,873,996 B1 * 10/2014 Buchanan ..... G03G 15/0898 399/98
2007/0237551 A1 * 10/2007 Kawai ..... G03G 15/0898 399/258

FOREIGN PATENT DOCUMENTS

JP 2010055035 A 3/2010

* cited by examiner

*Primary Examiner* — Gregory H Curran
(74) *Attorney, Agent, or Firm* — Alleman Hall Creasman & Tuttle LLP

(57) ABSTRACT

In a toner receiving device, an opening/closing member closes and opens the toner receiving port. The opening/closing member moves from a closing position to an opening position when attaching the toner case. The support mechanism includes a guide rail and a plurality of guide pieces and supports the opening/closing member. The guide rail includes a first rail portion and a second rail portion that are inserted between the plurality of guide pieces when the opening/closing member is at the closing position and the opening position, respectively. The first rail portion is thinner than the second rail portion so that a play in an up-down direction between the opening/closing member and the support mechanism is larger when the opening/closing member is at the closing position than when it is at the opening position.

8 Claims, 14 Drawing Sheets

TONER RECEIVING DEVICE, AND IMAGE FORMING APPARATUS INCLUDING THE SAME

INCORPORATION BY REFERENCE

This application is based upon and claims the benefit of priority from the corresponding Japanese Patent Application No. 2017-009345 filed on Jan. 23, 2017, the entire contents of which are incorporated herein by reference.

BACKGROUND

The present disclosure relates to a toner receiving device including an opening/closing member for opening and closing a toner receiving port through which to receive toner from a toner container, and relates to an image forming apparatus including the toner receiving device.

There is known an image forming apparatus such as a copier or a printer that forms an image on a print sheet by an electrophotographic system. A developing device is installed in the image forming apparatus. The developing device stores, in its inside, developer that includes toner. The developing device develops an electrostatic latent image formed on an image carrier such as a photoconductor drum, with the toner included in the developer. As developing is performed, the toner stored in the developing device is reduced. As a result, the image forming apparatus is configured such that a toner container storing toner is attached to the image forming apparatus, and the toner is supplied from the toner container to the developing device. The toner container is attached to the image forming apparatus in a detachable manner, and when the toner container becomes empty, the user removes the empty toner container and replace it with a new toner container filled with toner.

In this type of image forming apparatus, there is known a toner receiving device that includes a toner receiving port for receiving toner supplied from the toner container. The toner receiving device includes a shutter mechanism that includes a shutter member for opening and closing a toner receiving port. The shutter mechanism changes the shutter member from a closing state to an opening state when a toner discharge member is coupled with the shutter mechanism. In addition, in general, an elastic force of an elastic member such as a coil spring is used to return the shutter member from the opening state to the closing state.

SUMMARY

A toner receiving device according to an aspect of the present disclosure includes a toner receiving port, a seal member, an opening/closing member, and a support mechanism. The toner receiving port is an opening for receiving toner supplied from a toner case. The seal member is provided on a peripheral edge of the toner receiving port and is elastic. The opening/closing member is configured to close and open the toner receiving port by moving between a closing position at which to close the toner receiving port while contacting the seal member and an opening position at which to open the toner receiving port. The opening/closing member moves from the closing position to the opening position in conjunction with an attachment operation in which the toner case is attached to a predetermined attachment position. The support mechanism includes a guide rail and a plurality of guide pieces and supports the opening/closing member such that the opening/closing member can move between the closing position and the opening position.

The guide rail extends in an opening and closing direction of the opening/closing member, and is inserted between the plurality of guide pieces. The guide rail includes: a first rail portion configured to be inserted between the plurality of guide pieces when the opening/closing member is at the closing position; and a second rail portion configured to be inserted between the plurality of guide pieces when the opening/closing member is at the opening position. The first rail portion is formed to be thinner than the second rail portion so that a play in an up-down direction between the opening/closing member and the support mechanism is larger when the opening/closing member is at the closing position than when the opening/closing member is at the opening position.

An image forming apparatus according to another aspect of the present disclosure includes the toner receiving device, an attachment portion to which the toner case is attached at the attachment position, and an image forming portion configured to form an image by using toner supplied to the toner receiving device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 7A shows a state where the slide shutter is at a closing position, and FIG. 7B shows a state where the slide shutter is at an opening position.

FIG. 8A shows a state where the slide shutter is at the closing position; FIG. 8B shows a state where the toner container abuts on the slide shutter; FIG. 8C shows a state where the slide shutter has moved to the opening position; and FIG. 8D shows a state where a rotary shutter of the toner container has been rotated to an opening position, and a toner discharge port is opened.

DETAILED DESCRIPTION

Figure 1:
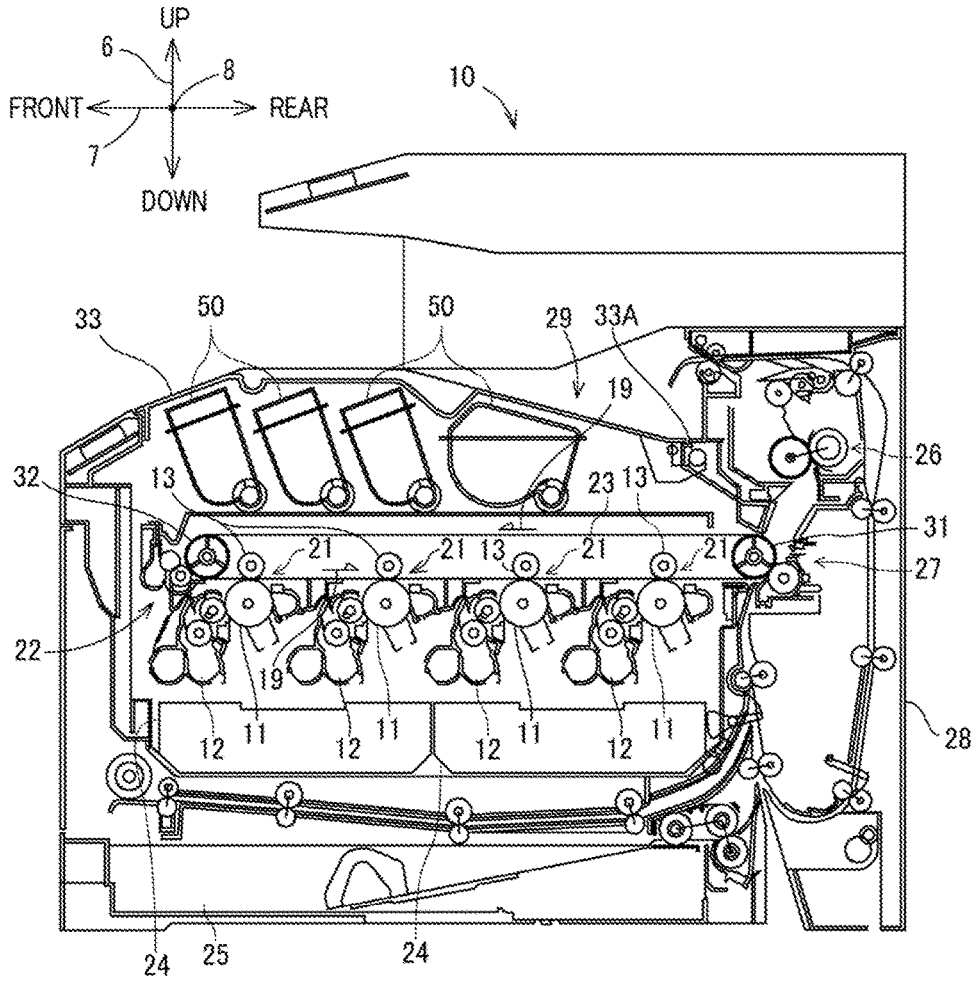
FIG. 1 is a diagram showing a configuration of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. It is noted that for the sake of explanation, an up-down direction 6 is defined based on the state where the image forming apparatus 10 is mounted on a flat mount surface (the state shown in FIG. 1). In addition, a front-rear direction 7 is defined on the supposition that the left side of FIG. 1 is the front side of the image forming apparatus 10. In addition, a left-right direction 8 (a direction vertical to the plane of FIG. 1) is defined on the basis of the image forming apparatus 10 of FIG. 1 viewed from the front side (front). As a result, the front side of FIG. 1 is the right side, and the depth side of FIG. 1 is the left side.

[Image Forming Apparatus 10]

The image forming apparatus 10 has al least a print function. As shown in FIG. 1, the image forming apparatus 10 is a so-called tandem-type color printer. The image forming apparatus 10 prints an image on a sheet of print paper by using developer that includes toner. It is noted that the image forming apparatus 10 is not limited to an image forming apparatus that forms a color image, but may be one that forms a monochrome image.

As shown in FIG. 1, the image forming apparatus 10 includes, as major components, four image forming portions 21, an intermediate transfer unit 22, a sheet feed device 25, a fixing device 26, a secondary transfer device 27, an exposure device 24, and four toner containers 50 (50A-50D). These components are disposed in an apparatus main body 28 that is a housing that constitutes an external frame (not shown), an internal frame (not shown) and the like of the image forming apparatus 10. It is noted that the toner containers 50 are an example of the toner case in the image forming apparatus 10.

The four image forming portions 21 are disposed below the intermediate transfer unit 22 in the apparatus main body 28. The image forming portions 21 are aligned along the front-rear direction 7. The image forming portions 21 form toner images on photoconductor drums 11, and transfer the toner images to a transfer belt 23 provided in the intermediate transfer unit 22 by overlaying the toner images onto the belt in sequence. The transfer belt 23 moves in a direction indicated by the arrow 19, and the toner images are transferred in sequence to the transfer belt 23 while it is moving. In the example shown in FIG. 1, in order from the downstream side (the right side of FIG. 1) in the movement direction of the transfer belt 23 (the direction indicated by the arrow 19), the image forming portions 21 for black, yellow, cyan, and magenta are arranged in a row in the apparatus main body 28.

The image forming portions 21 execute an image formation process of forming an image on a print sheet based on a so-called electrophotographic system. Each of the image forming portions 21 includes a photoconductor drum 11, a charging device (not shown), a developing device 12, and a primary transfer device 13. The developing device 12 develops a toner image on the photoconductor drum 11. Specifically, the developing device 12 causes toner to adhere to an electrostatic latent image on the photoconductor drum 11, thereby developing the electrostatic latent image with the toner to form a toner image as a visual image on the surface of the photoconductor drum 11.

The intermediate transfer unit 22 is provided above the image forming portions 21. A driving pulley 31 and a driven pulley 32 are respectively provided at opposite ends of the intermediate transfer unit 22 in the front-rear direction 7. The transfer belt 23 is suspended between and supported by the driving pulley 31 and the driven pulley 32. This allows the belt surface of the transfer belt 23 to extend horizontally in the front-rear direction 7. The transfer belt 23 can move in a direction indicated by the arrow 19 in a state where the transfer belt 23 is supported by the driving pulley 31 and the driven pulley 32. The transfer belt 23 is an endless, annular belt formed from a material such as rubber or urethane.

Supported by the driving pulley 31 and the driven pulley 32, the transfer belt 23 can move (run) in a state where its surface is in contact with the surfaces of the photoconductor drums 11. When the surface of the transfer belt 23 passes through between the photoconductor drums 11 and the primary transfer device 13, the toner images of respective colors are transferred in sequence from the photoconductor drums 11 to the surface of the transfer belt 23 in such a way as to be overlaid with each other. This allows a color toner image to be formed on the surface of the transfer belt 23.

The secondary transfer device 27 is disposed in a rear portion of the apparatus main body 28. The secondary transfer device 27 transfers the color toner image composed of toner images of the plurality of colors transferred to the transfer belt 23, to a print sheet conveyed from a sheet supply tray of the sheet feed device 25. This allows the color toner image to be formed on the print sheet. The print sheet with the color toner image transferred thereon is conveyed to the fixing device 26. The fixing device 26 fixes the color toner image transferred to the print sheet, to the print sheet by heat. After the fixing by the fixing device 26, the print sheet is discharged onto a sheet discharge tray 29 provided on an upper part of the apparatus main body 28.

The four toner containers 50 (50A-50D) are disposed above the intermediate transfer unit 22. Inside the apparatus main body 28, the four toner containers 50 are aligned in a row along the transfer belt 23 in the front-rear direction 7. The toner containers 50 are configured to supply toner to the developing devices 12 of corresponding colors via a toner conveying portion 30 (an example of the toner receiving device).

Figure 2:
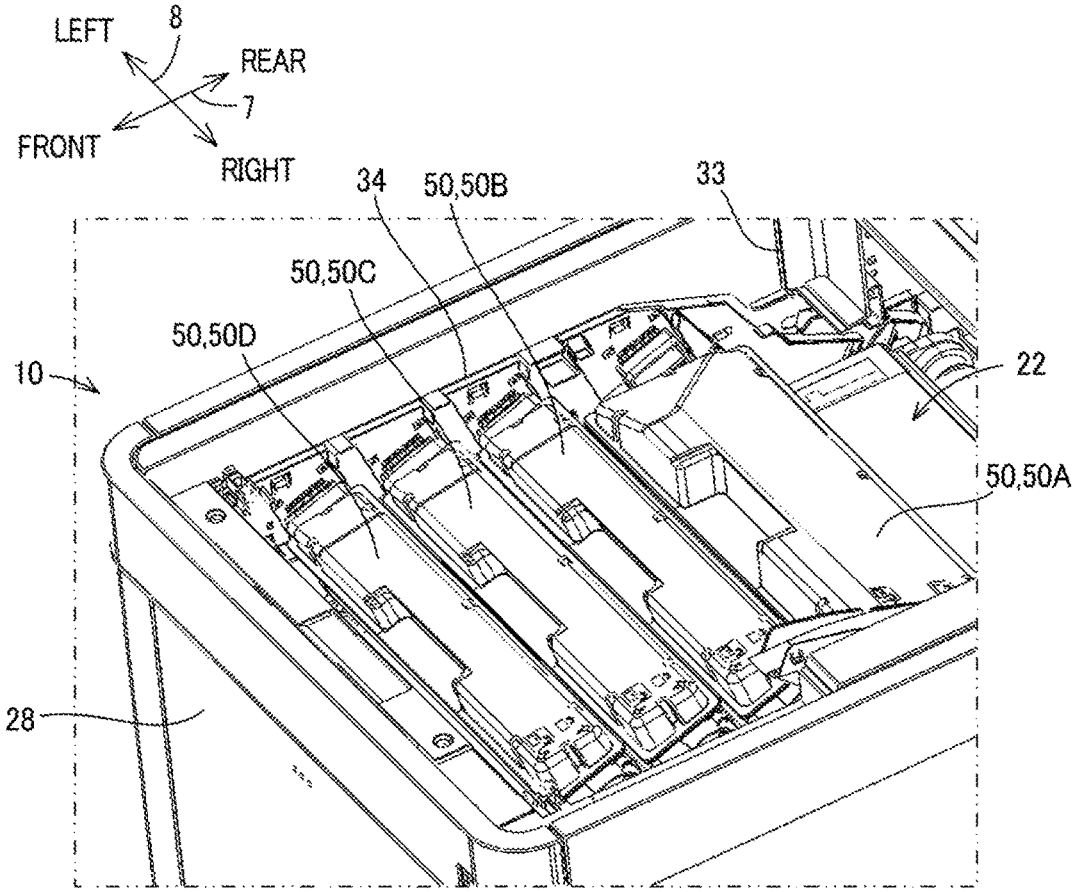
FIG. 2 is a perspective diagram showing a state where toner containers are attached to a container attachment portion of the image forming apparatus.

As shown in FIG. 2, a container attachment portion 34 (an example of the attachment portion) to which the plurality of toner containers 50 are attached is provided in the apparatus main body 28. Specifically, the container attachment portion 34 is provided on the intermediate transfer unit 22. The container attachment portion 34 is integrally formed with an upper part of the intermediate transfer unit 22.

A top cover 33 is provided on the upper part of the apparatus main body 28. The top cover 33 is supported so as to be opened and closed around a support shaft 33A of the apparatus main body 28 (see FIG. 1). The support shaft 33A is provided on the rear side of the four toner containers 50. When the top cover 33 is pivoted upward (in an opening direction), the container attachment portion 34 is exposed. The container attachment portion 34 includes a plurality of storage portions that can store the toner containers 50 respectively. The toner containers 50 are attached to the container attachment portion 34 such that the toner containers 50 are respectively stored in the storage portions. It is noted that the container attachment portion 34 is not limited to being integrally formed with the upper part of the intermediate transfer unit 22, but may be attached to the apparatus main body 28 as a member independent of the intermediate transfer unit 22.

Figure 3:
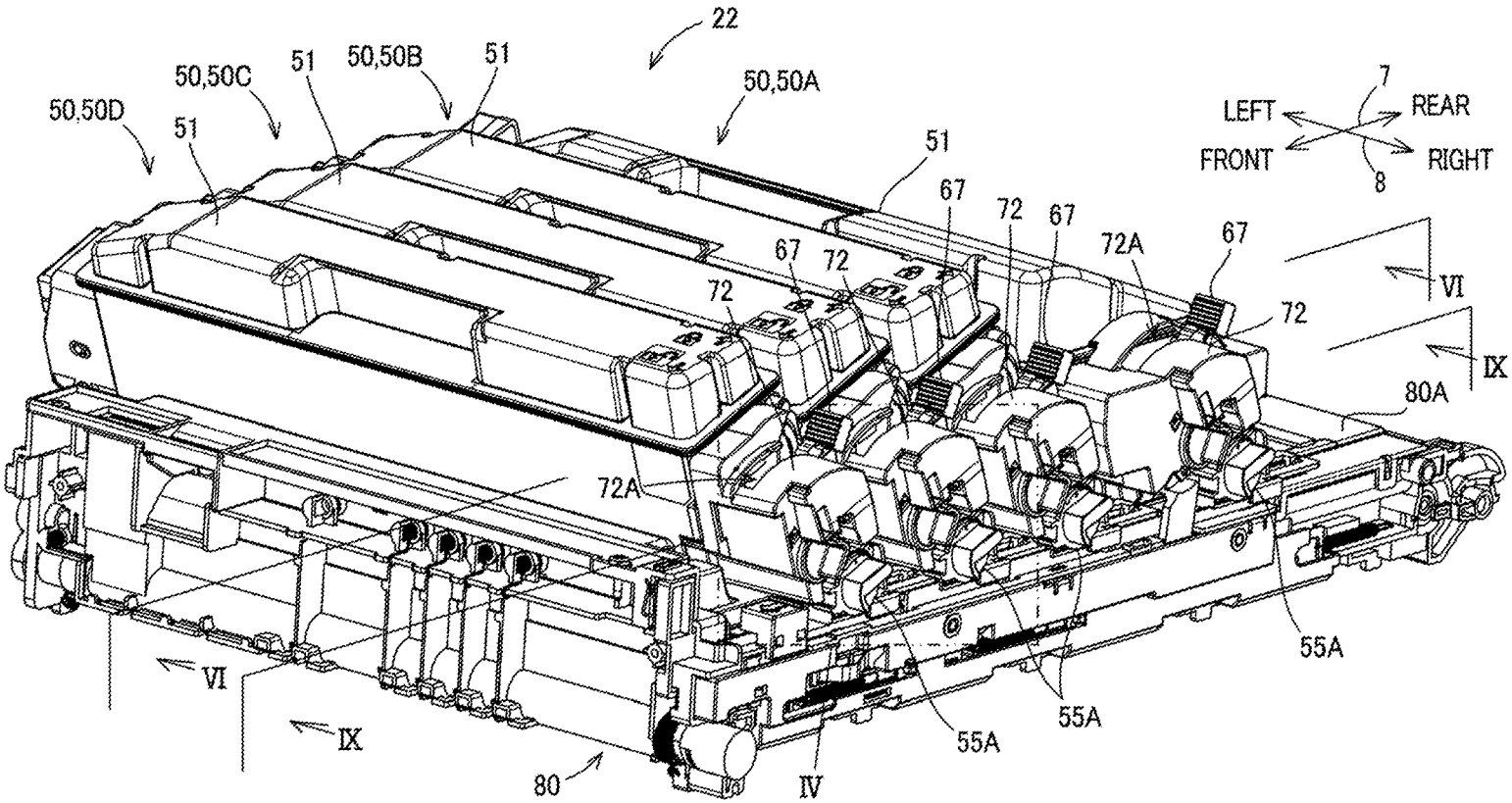
FIG. 3 is a perspective diagram showing a configuration of the toner containers and an intermediate transfer unit.

The toner containers 50 store toner of different colors that correspond to the colors of the image forming portions 21. Specifically, the toner containers 50 (50A-50D) store toner of black, yellow cyan, and magenta, respectively. As shown in FIG. 2 and FIG. 3, among the four toner containers 50, a toner container 50A positioned the most rear side is a large-capacity type and can store a larger amount of toner than the other toner containers 50B-50D. The toner container 50A stores black toner. The toner containers 50B-50D have the same shape and capacity. The toner container 50B stores yellow toner, the toner container 50C stores cyan toner, and the toner container 50D stores magenta toner.

[Configuration of Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner containers 50A-50D are described as a toner container 50.

Figure 4:
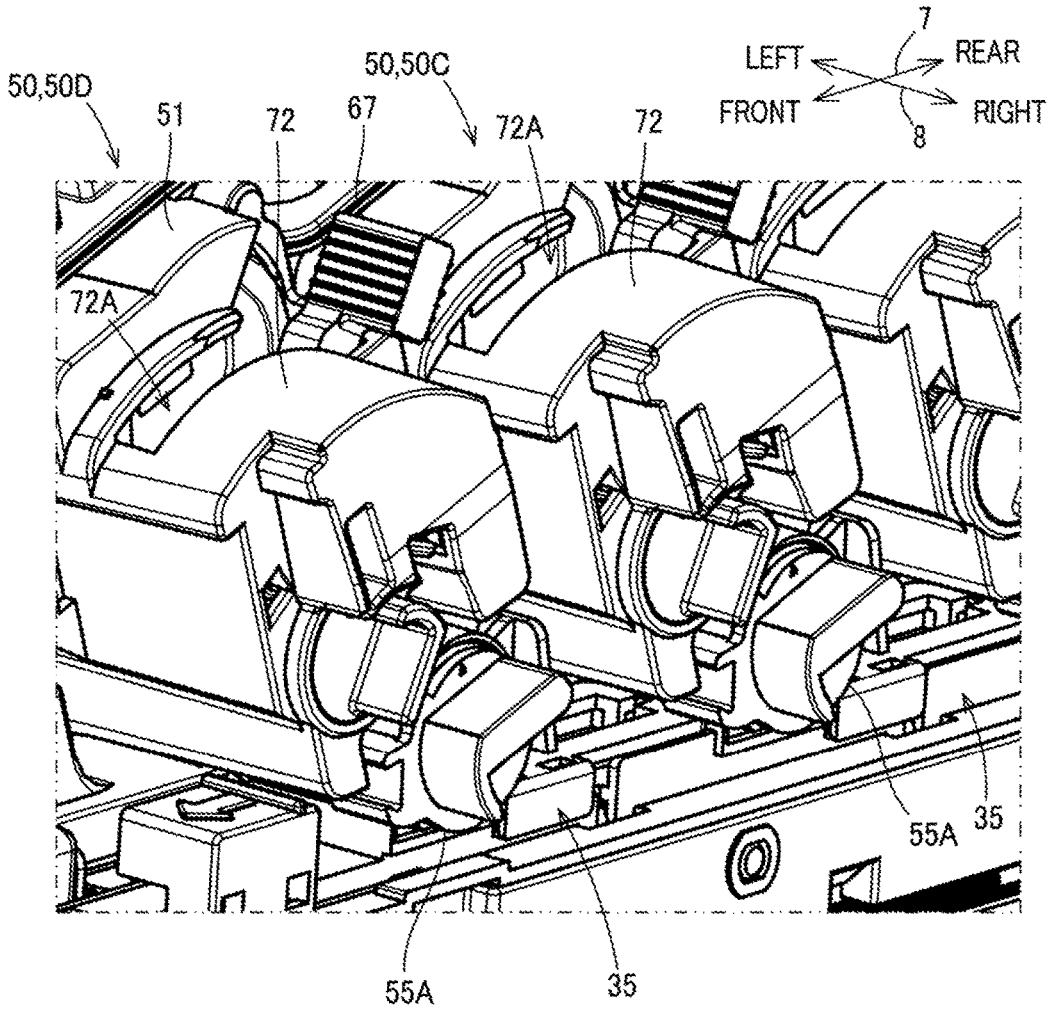
FIG. 4 is an enlargement diagram of a main part IV shown in FIG. 3.
Figure 6:
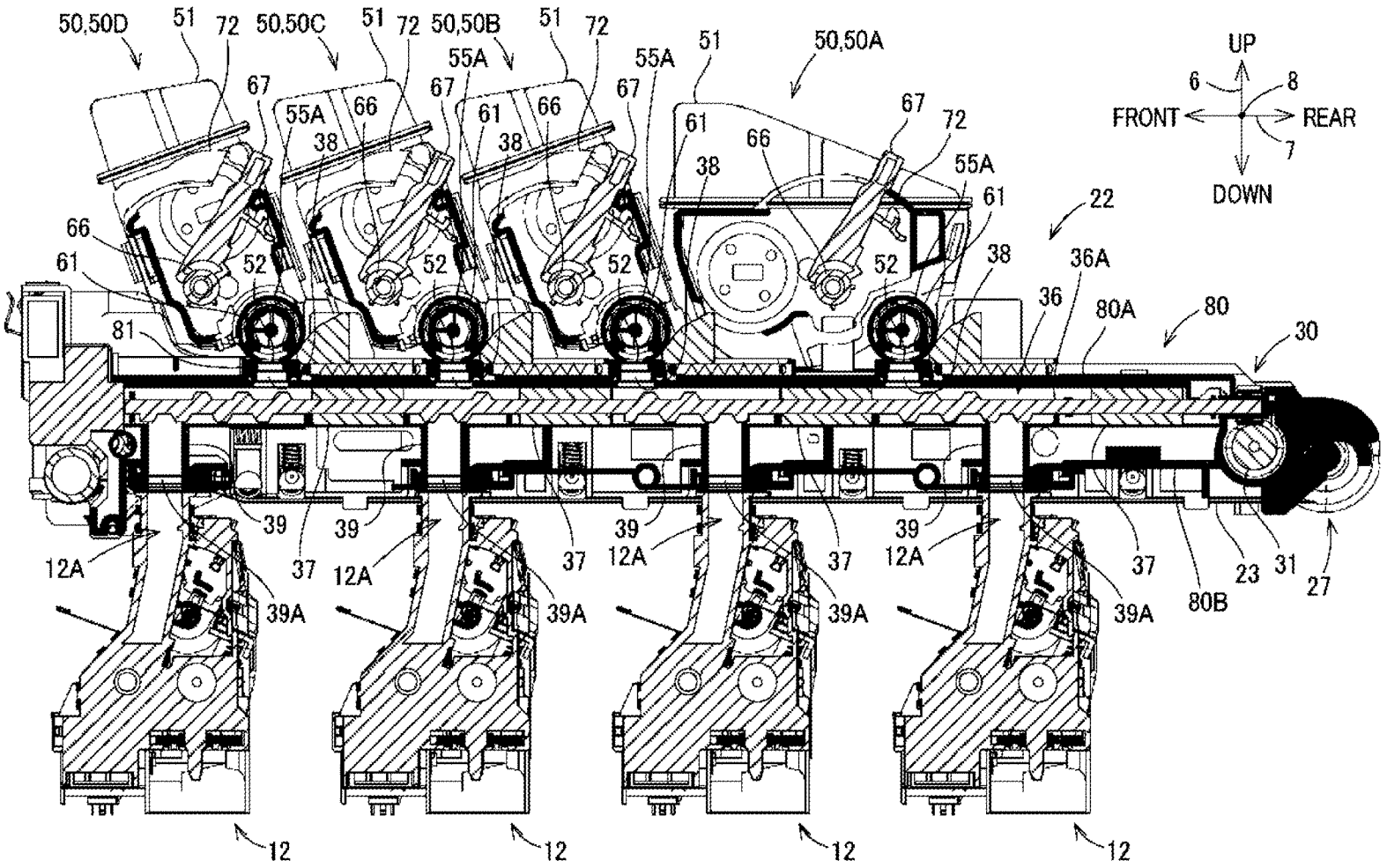
FIG. 6 is a diagram showing a cross section taken along a vertical cutting surface VI-VI shown in FIG. 3 that passes through a center of a slide shutter.

The toner container 50 stores toner that is to be supplied to the developing device 12. As shown in FIG. 3 and FIG. 4, the toner container 50 includes a housing 51, a toner discharge port 52 (see FIG. 6), a rotary shutter 61 (see FIG. 6), and an operation lever 67. The housing 51 is attached to the container attachment portion 34 of the image forming apparatus 10 in a detachable manner. As shown in FIG. 6, the toner discharge port 52 is formed in the housing 51. The toner discharge port 52 is formed in a right end portion of a bottom surface of the housing 51. In addition, as shown in FIG. 4, the operation lever 67 is provided on the housing 51 so as to be operated by the user.

The housing 51 is formed from a resin material, and as shown in FIG. 3, formed in the shape of a box that is elongated in the left-right direction 8. That is, the longitudinal direction of the housing 51 matches the left-right direction 8 of the image forming apparatus 10 shown in FIG. 1. It is noted that in FIG. 3, the up-down direction 6, the front-rear direction 7, and the left-right direction 8 are defined in a state where the intermediate transfer unit 22 is attached to the apparatus main body 28. In the inside of the housing 51, a stirring paddle (not shown) and a spiral shaft (not shown) are provided, wherein the stirring paddle is configured to stir the toner, and the spiral shaft is configured to convey the toner to the toner discharge port 52 (see FIG. 6).

As shown in FIG. 6, the toner discharge port 52 is formed to pierce through a side wall of a bottom portion of the housing 51 downward. Specifically, as shown in FIG. 6, an approximately cylindrical protruding portion 55A protruding rightward is formed on a right end portion of the housing 51. The toner discharge port 52 is formed to pierce through a circumferential wall of the protruding portion 55A downward. The rotary shutter 61 is pivotably provided in the protruding portion 55A. The toner discharge port 52 is opened and closed by the rotary shutter 61 that is provided in the protruding portion 55A. After the toner container 50 is attached to a predetermined attachment position of the container attachment portion 34, the user manually operates the operation lever 67 so that the rotary shutter 61 is rotated from a position to close the toner discharge port 52, to a position to open the toner discharge port 52. This makes it possible to discharge the toner from the toner discharge port 52 to outside.

Hereinafter, a position of the rotary shutter 61 (the position shown in FIG. 6) for opening the toner discharge port 52 is referred to as a first opening position. In addition, a position of the rotary shutter 61 for closing the toner discharge port 52 is referred to as a first closing position.

When the toner container 50 is attached to the container attachment portion 34, the toner discharge port 52 is disposed at a position that faces a toner receiving port 38 (see FIG. 5) that is described below, and becomes in close contact with the toner receiving port 38. The attachment position of the toner container 50 in the container attachment portion 34 is determined such that the above-described positional relationship is satisfied. The operation lever 67 is used to open and close the toner discharge port 52 in a state where the toner container 50 is attached to the container attachment portion 34. As shown in FIG. 4, the operation lever 67 is provided in the right end portion of the housing 51. As shown in FIG. 6, the operation lever 67 is vertical to a shaft portion 66 that is rotatably supported by the housing 51, and extends upward.

Figures 8A, 8B, 8C, 8D:
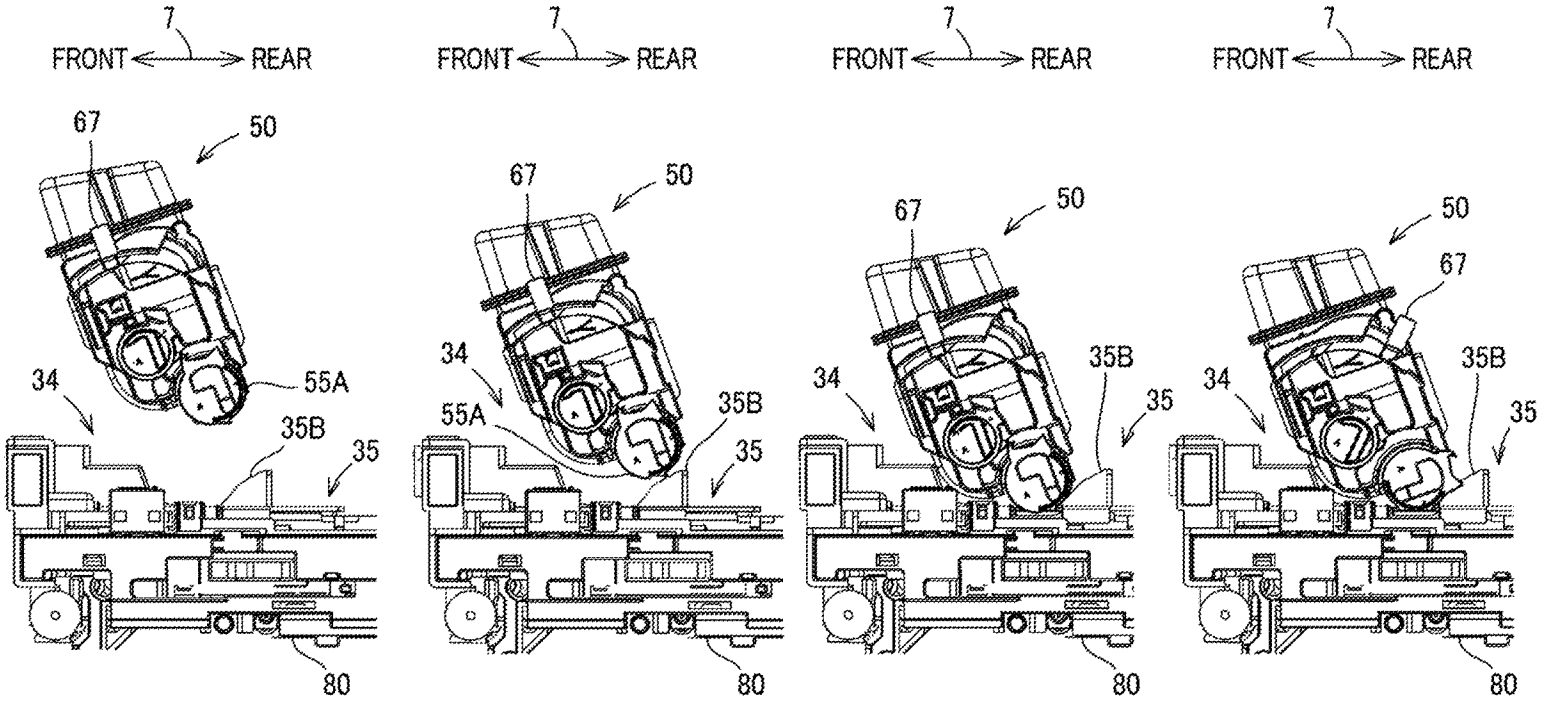
FIG. 8A to FIG. 8D are diagrams showing how the slide shutter slides from the closing position to the opening position in correspondence with attachment stages of a toner container.

In the present embodiment, the operation lever 67 can be displaced between a first attitude (the attitude shown in FIG. 8C) and a second attitude (the attitude shown in FIG. 6 and FIG. 8D), wherein in the first attitude, the operation lever 67 is inclined frontward, and in the second attitude, the operation lever 67 is inclined rearward. Here, the first attitude corresponds to the first closing position of the rotary shutter 61. Specifically, to keep the rotary shutter 61 at the first closing position, the operation lever 67 is operated and moved to the first attitude. On the other hand, the second attitude corresponds to the first opening position of the rotary shutter 61. Specifically, to rotate and displace the rotary shutter 61 to the first opening position, the operation lever 67 is operated and moved to the second attitude.

A drive transmission mechanism (not shown) such as a gear is provided between the operation lever 67 and the rotary shutter 61. As a result, when the operation lever 67 is displaced from the first attitude to the second attitude, the rotary shutter 61 is pivoted from the first closing position to the first opening position. This opens the toner discharge port 52. In addition, when the operation lever 67 is displaced from the second attitude to the first attitude, the rotary shutter 61 is pivoted from the first opening position to the first closing position. This closes the toner discharge port 52.

As shown in FIG. 4, a cover 72 is attached to the right end portion of the housing 51. The cover 72 is attached so as to cover a base-end-side part of the operation lever 67. A slit 72A of an arc shape is formed in an upper surface of the cover 72, and the operation lever 67 protrudes upward from the slit 72A.

It is noted that although the present embodiment describes an example case where the drive transmission mechanism is attached to the right end portion of the toner container 50, it is possible to adopt a configuration where the driving force that is transmitted when the operation lever 67 is operated, is transmitted to the rotary shutter 61 via a drive transmission mechanism that is provided in the apparatus main body 28.

[Configuration of Intermediate Transfer Unit 22]

The following describes a configuration of the intermediate transfer unit 22. FIG. 6 is a cross-sectional diagram of the intermediate transfer unit 22 taken along a cutting surface (cutting surface VI-VI shown in FIG. 3) extending in the front-rear direction 7 to pass through the operation levers 67. In FIG. 6, the toner containers 50 and the developing devices 12 are shown, as well as the intermediate transfer unit 22.

As shown in FIG. 3, the intermediate transfer unit 22 includes a unit main body 80 provided as a housing. The unit main body 80 is formed in the shape of a rectangular parallelepiped that is long in the front-rear direction 7 and the left-right direction 8, and a size in the up-down direction 6 is smaller than sizes in the front-rear direction 7 and the left-right direction 8. The driving pulley 31 and the driven pulley 32 are rotatably supported at opposite ends of the unit main body 80 in the front-rear direction 7, and the transfer belt 23 is supported by the driving pulley 31 and the driven pulley 32. The unit main body 80 includes an upper surface portion 80A (see FIG. 3) that constitutes an upper surface thereof, and a lower surface portion 80B (see FIG. 6) that constitutes a lower surface thereof. The container attachment portion 34 is provided on the unit main body 80, namely, provided on the upper surface portion 80A.

As shown in FIG. 6, the toner conveying portion 30 is integrally provided with the right end portion of the intermediate transfer unit 22. Specifically, the right end portion of the unit main body 80 protrudes to the right of the transfer belt 23, and the protruding portion is the toner conveying portion 30. The toner conveying portion 30 is an example of the toner receiving device of the present disclosure. In an inside of the toner conveying portion 30, a toner conveyance path 36 for conveying toner is formed. The toner conveyance path 36 is formed in an inside of the unit main body 80. The toner conveyance path 36 is used to convey the toner supplied from the toner containers 50 to the developing devices 12. In the present embodiment, the toner conveyance path 36 is formed as a portion from the toner receiving ports 38 described below to openings 39A of toner supply portions 39 described below. The toner conveyance path 36 extends in the unit main body 80 in the front-rear direction 7. The toner conveyance path 36 is divided into four passages that respectively correspond to the four toner containers 50. The toner conveyance path 36 is partitioned into the four passages by partitioning members 37 so that toner of different colors is not mixed in the toner conveyance path 36.

In an inside of the toner conveyance path 36, a spiral shaft 36A for conveying toner in the toner conveyance path 36 is provided. The spiral shaft 36A is formed by putting a spiral blade to a rotation shaft. As the spiral shaft 36A rotates upon receiving a driving force, the toner is conveyed along the toner conveyance path 36. In the present embodiment, the spiral shaft 36A conveys toner that has been supplied from the toner containers 50 via the toner receiving ports 38 described below, to the toner supply portions 39. The toner conveyed to the toner supply portions 39 drops downward therein, and enters the developing devices 12 from the openings 39A of the toner supply portions 39 via toner replenishment ports 12A.

Figure 5:
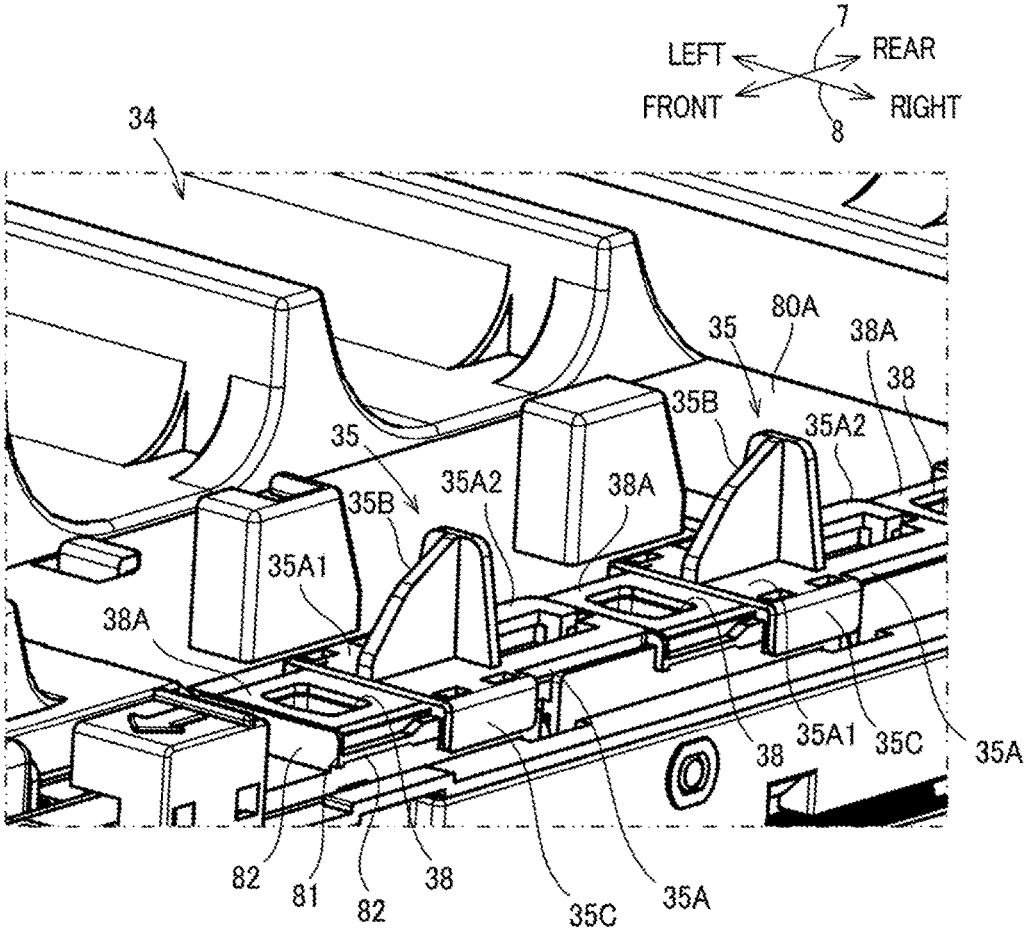
FIG. 5 is a diagram showing a state where the toner containers have been removed from a state of FIG. 3.

As shown in FIG. 5 and FIG. 6, the toner conveying portion 30 includes a plurality of toner receiving ports 38 for receiving toner supplied from the toner containers 50. The plurality of toner receiving ports 38 are provided in the right end portion of the upper surface portion 80A. On the upper surface portion 80A, a mount portion 81 (see FIG. 5) is formed, wherein the mount portion 81 is rectangular and long in the front-rear direction 7, and projects upward from an upper surface of the upper surface portion 80A. In a front-side inner portion of the mount portion 81, recessed portions are formed. The outer circumference of the mount portion 81 has four side walls 82. In the present embodiment, the toner receiving ports 38 are formed in bottom surfaces of the recessed portions of the mount portion 81. Four toner receiving ports 38 are provided respectively in correspondence with the four toner containers 50. The toner receiving ports 38 are arranged on a straight line extending through the upper surface portion 80A along the front-rear direction 7. The toner receiving ports 38 are each formed in the shape of a rectangle so as to pierce through the upper surface portion 80A downward and communicate with the toner conveyance path 36. In addition, each of the toner receiving ports 38 is disposed at a position at which it can communicate with the toner discharge port 52 formed in a corresponding toner container 50 in a state where the toner container 50 is attached to the container attachment portion 34 (hereinafter, the state is also referred to as a container attached state). That is, in the container attached state, the toner receiving ports 38 are provided below the toner discharge ports 52. It is noted that to prevent the toner from leaking around the toner discharge ports 52 and the toner receiving ports 38, the toner receiving ports 38 are configured to become in close contact with the toner discharge ports 52 in the container attached state.

The toner conveying portion 30 includes a plurality of toner supply portions 39. The plurality of toner supply portions 39 are provided in the right end portion of the lower surface portion 80B. Four toner supply portions 39 are provided respectively in correspondence with the four toner containers 50. The toner supply portions 39 are arranged on a straight line extending through the lower surface portion 80B along the front-rear direction 7. The toner supply portions 39 are each formed in the shape of a tube extending in the up-down direction 6 and openings at their upper ends communicate with the toner conveyance path 36. The openings 39A at the lower ends of the toner supply portions 39 are toner supply ports for supplying the toner to the developing devices 12. The openings 39A communicate with the toner replenishment ports 12A of the developing devices 12. Accordingly, the toner conveyance path 36 is configured to convey the toner supplied from the toner receiving ports 38 to the openings 39A.

As shown in FIG. 5, an elastic seal member 38A is provided on the peripheral edge of each of the toner receiving ports 38. The seal member 38A is formed as a sheet from an elastic member such as sponge or nonwoven fabric. A rectangular opening corresponding to the toner receiving port 38 is formed at the center of the seal member 38A. When a slide shutter 35 that is described below is disposed at a closing position (hereinafter referred to as a "second closing position") closing the toner receiving port 38, the seal member 38A is pressed downward by the slide shutter 35 and compressed.

The toner conveying portion 30 includes the slide shutters 35 (an example of the opening/closing member) for opening and closing the toner receiving ports 38. Each of the slide shutters 35 is configured to open and close a corresponding toner receiving port 38 by moving between the second closing position (the position shown in FIG. 7A) at which to close the toner receiving port 38, and an opening position (the position shown in FIG. 7B, hereinafter referred to as a "second opening position") at which to open the toner receiving port 38. The slide shutter 35 is supported by a slide support mechanism 60 (an example of the support mechanism, see FIG. 9 and FIG. 10) described below, in such a way as to slide on the upper surface portion 80A in the front-rear direction 7. When the slide shutter 35 is slid from the second opening position to the second closing position, the slide shutter 35 comes into contact with and compresses the seal member 38A, and closes the toner receiving port 38.

The slide shutter 35 includes a plate-like base portion 35A, an abutting portion 35B, and a guide portion 35C, wherein the base portion 35A is disposed to be in surface contact with an upper surface of the mount portion 81 of the upper surface portion 80A, the abutting portion 35B is fan-shaped in a cross section and projects obliquely upward and frontward from the upper surface of the base portion 35A, and the guide portion 35C extends downward from opposite ends of a front portion 35A1 of the base portion 35A that are opposed to each other in the left-right direction 8. The guide portion 35C is disposed to cover, from outside, the opposite side walls 82 of the mount portion 81 (see FIG. 8) that are opposed to each other in the left-right direction 8. At the center of a rear portion 35A2 of the base portion 35A, an opening 42 (see FIG. 7A) is formed to extend in the front-rear direction 7.

Figure 7A:
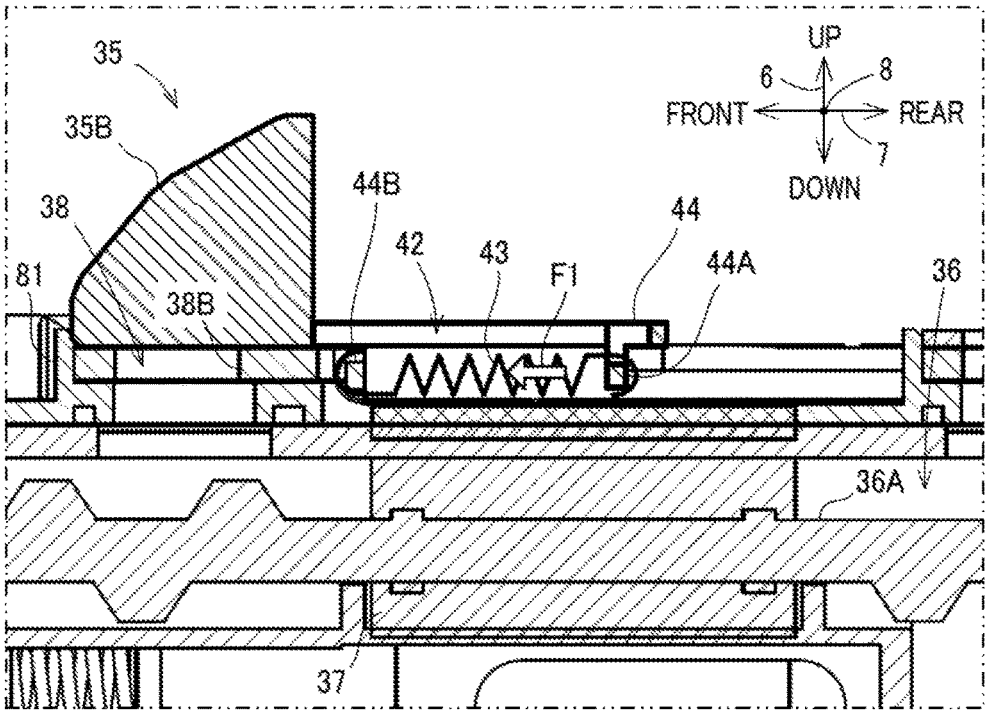
FIG. 7A and FIG. 7B are partial enlargement diagrams of a periphery of the slide shutter shown in the cross section of FIG. 6.
Figure 7B:
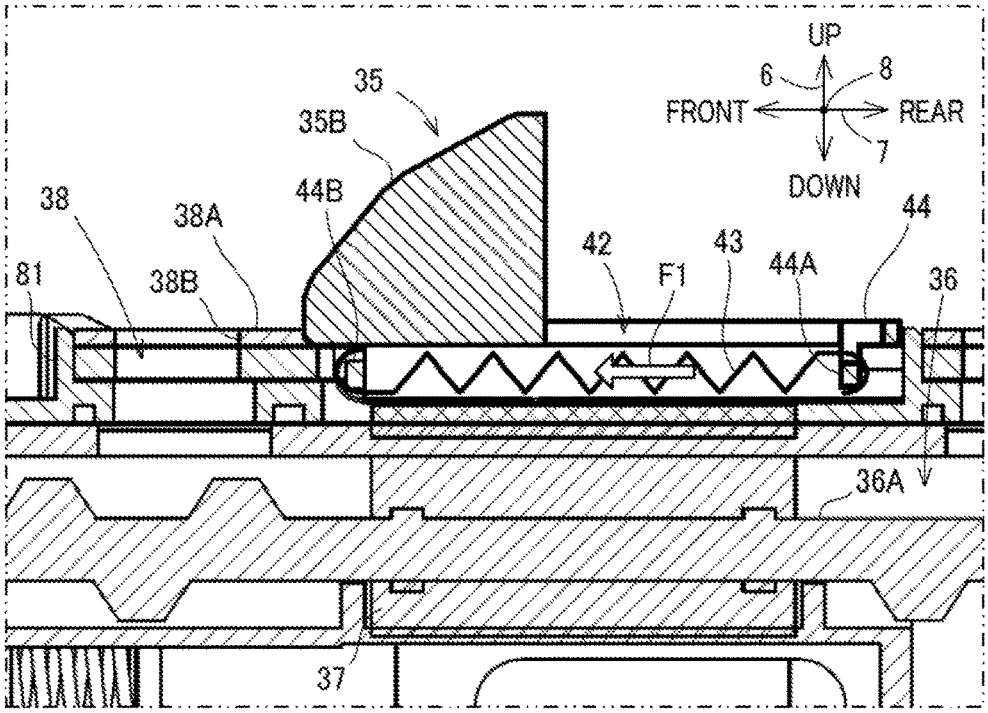

As shown in FIG. 7A, a tension coil spring 43 (an example of the elastic member) is attached to the slide shutter 35. The tension coil spring 43 applies an elastic biasing force F1 to the slide shutter 35 in a closing direction in which the slide shutter 35 moves from the second opening position to the second closing position. On a rear end portion 44 of the slide shutter 35 located on the rear side (on the second opening position side), a projection piece 44A (an example of the locking portion) is formed to project downward from a lower surface of the rear end portion 44. One end of the tension coil spring 43 is attached to the projection piece 44A. In addition, the other end of the tension coil spring 43 is attached to a fixed piece 44B (an example of the fixed portion) that is located at a position on the front side (on the second closing position side) separate from the projection piece 44A. The fixed piece 44B is not provided on the slide shutter 35, but is formed integrally with an inner portion of the upper surface portion 80A. With the tension coil spring 43 attached to the slide shutter 35 as described above, when no external force except for the elastic biasing force F1 from the tension coil spring 43 is applied to the slide shutter 35, the slide shutter 35 keeps to be disposed at the second closing position by the elastic biasing force F1 from the tension coil spring 43. On the other hand, when a force exceeding the elastic biasing force F1 from the tension coil spring 43 is applied to the slide shutter 35 rearward, the slide shutter 35 slides from the second closing position to the second opening position against the elastic biasing force F1 and is disposed at the second opening position (see FIG. 7B).

The abutting portion 35B is configured to abut on a bottom portion of the toner container 50 during an attachment operation in which the toner container 50 is attached to a corresponding attachment position in the container attachment portion 34. Specifically, when the toner container 50 is inserted in the container attachment portion 34 in a state where the slide shutter 35 is at the second closing position, during the insertion process, the protruding portion 55A located on the rear side of the bottom portion of the toner container 50 proceeds toward the abutting portion 35B (see FIG. 8A). Subsequently, when the toner container 50 is further inserted, the protruding portion 55A abuts on a curved portion of the abutting portion 35B (see FIG. 8B), and with a further insertion of the toner container 50, the protruding portion 55A reaches the attachment position (see FIG. 8C). At this time, during the time period since when the toner container 50 abuts on the curved portion of the abutting portion 35B until it reaches the attachment position, the protruding portion 55A applies a pressing force to the abutting portion 35B in the opening direction, namely, rearward. Upon receiving the pressing force, the slide shutter 35 moves from the second closing position to the second opening position, and the toner receiving port 38 is opened. Thereafter, as the operation lever 67 is operated to be moved from the first attitude to the second attitude, the toner discharge port 52 is opened (see FIG. 8D). This allows the toner to be discharged from the toner discharge port 52 to the toner receiving port 38.

Meanwhile, there is a case where, in order to enhance the sealing performance of the toner receiving port 38, the seal member 38A made of an elastic material such as sponge is provided on the peripheral edge of the toner receiving port 38. In that case, if the slide shutter 35 is disposed at the second closing position for closing the toner receiving port 38, the seal member 38A is pressed and compressed between the slide shutter 35 and the peripheral edge of the toner receiving port 38. This allows the toner receiving port 38 to have an excellent sealing performance. However, since toner is stored in the toner conveyance path 36 of the toner conveying portion 30, flying toner exists in a space from the toner receiving port 38 to the toner conveyance path 36. As a result, if a toner container 50 is not attached to the container attachment portion 34 and the slide shutter 35 is disposed at the second closing position for a long time, the flying toner adheres to the seal member 38A and an inner surface 38B of the toner receiving port 38 (see FIG. 7B). In that case, during the process in which the toner container 50 is attached to the container attachment portion 34, when the toner container 50 abuts on the abutting portion 35B, and the slide shutter 35 is moved from the second closing position to the second opening position, the toner that had adhered to the inner surface 38B may be peeled off by the shock of the contact with the abutting portion 35B, and the toner may be scattered to outside from the toner receiving port 38 before the attachment of the toner container 50 is completed. Accordingly, in the present embodiment, the slide support mechanism 60 described below is provided in the toner conveying portion 30. The provision of the slide support mechanism 60 makes it possible to prevent the toner that had adhered to the inner surface 38B from being scattered to outside from the toner receiving port 38 when the slide shutter 35 is opened during an attachment of the toner container 50.

The following describes the slide support mechanism 60 with reference to FIG. 9 to FIG. 11B.

Figure 9:
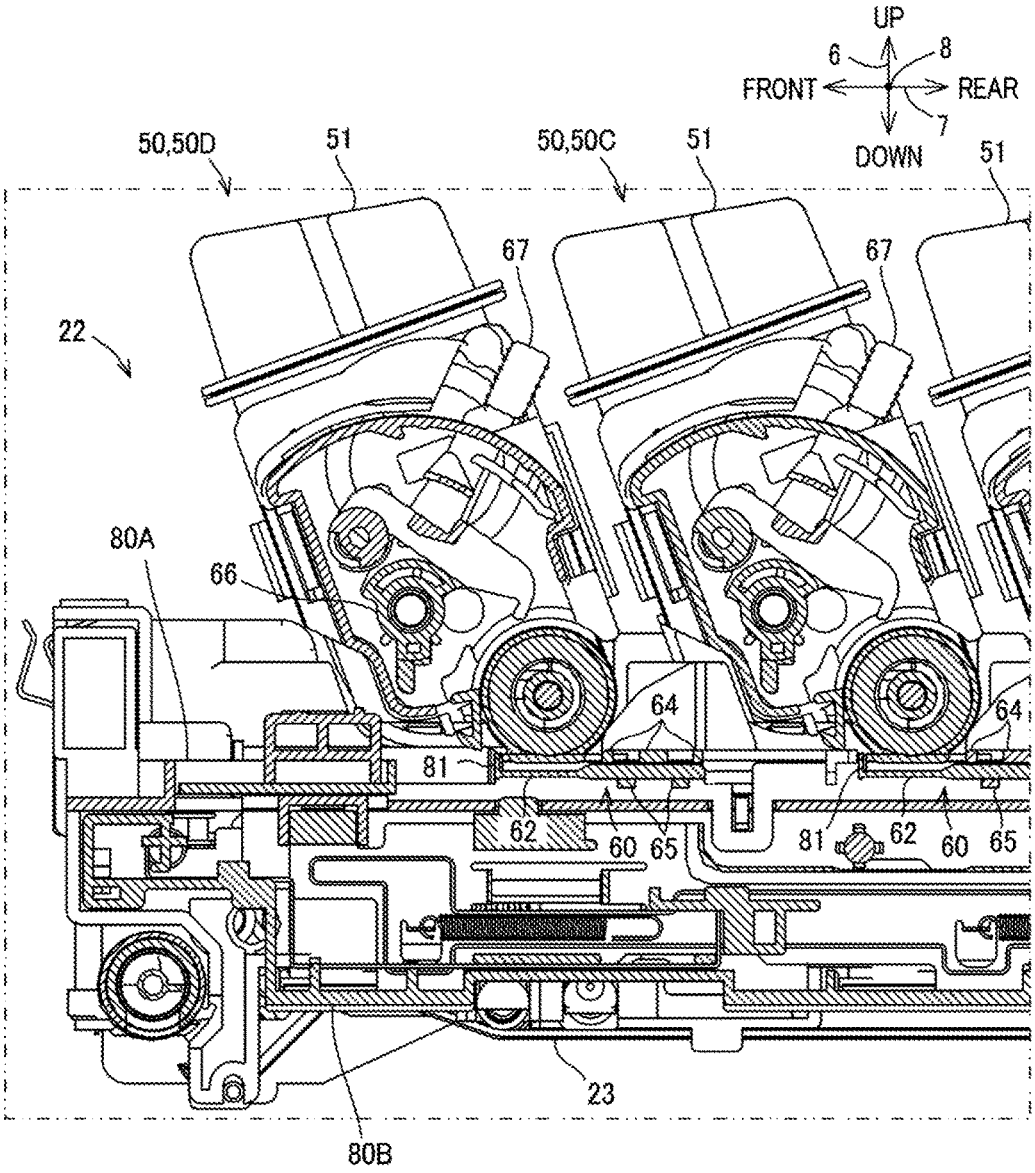
FIG. 9 is an enlarged diagram of a cross section taken along a vertical cutting surface IX-IX that passes through a right end portion of the slide shutter.
Figure 10:
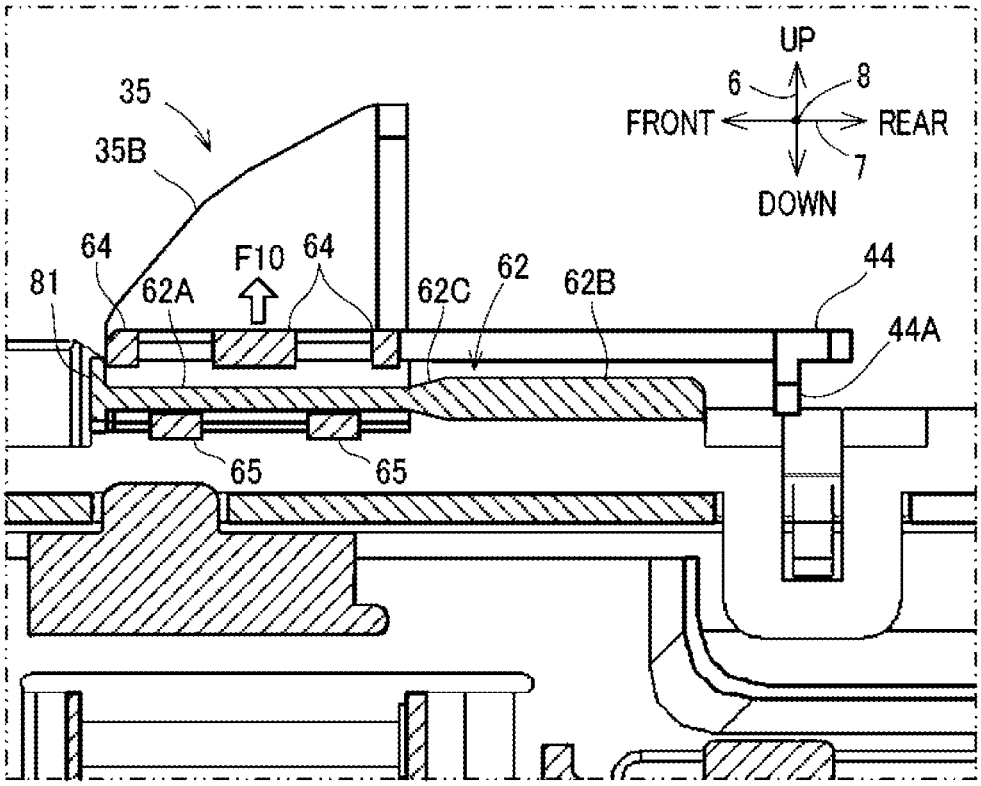
FIG. 10 is a partially enlarged diagram showing the slide shutter and a slide support mechanism of the cross-sectional diagram of FIG. 9.
Figure 11A:
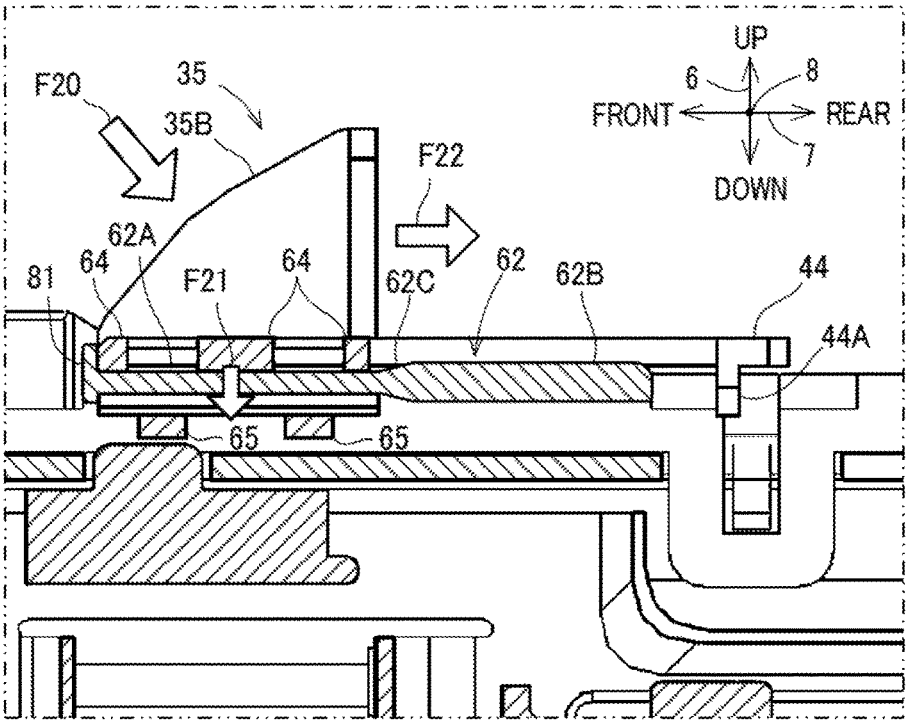
FIG. 11A is a cross-sectional diagram for explaining a downward operation of the slide shutter when the toner container is attached.
Figure 11B:
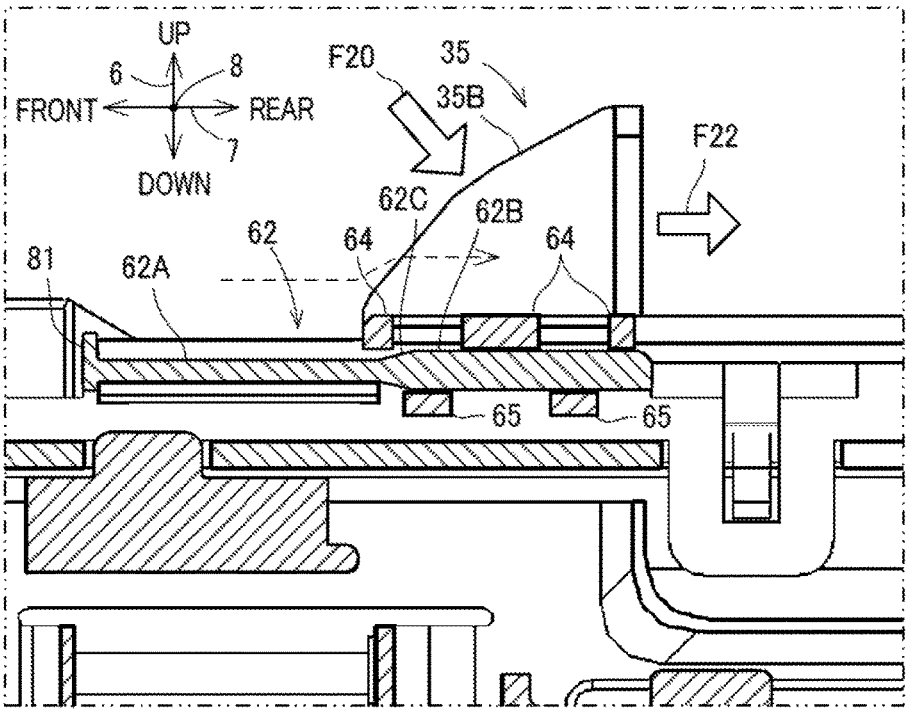
FIG. 11B is a cross-sectional diagram for explaining an operation of the slide shutter in an opening direction when the toner container is attached.

FIG. 9 is an enlarged diagram of a cross section taken along a vertical cutting surface IX-IX that passes through the right end portion of the slide shutter 35 shown in FIG. 3. FIG. 10 is a partially enlarged diagram showing a periphery of the slide shutter 35 in the cross-sectional diagram of FIG. 9. In FIG. 9 and FIG. 10, the toner receiving port 38, the seal member 38A, and the guide portion 35C are not shown since they are hidden by other members.

As shown in FIG. 9 and FIG. 10, the slide support mechanism 60 is composed of guide rails 62 and guide pieces 64 and 65, wherein the guide rails 62 are provided in the upper surface portion 80A, and the guide pieces 64 and 65 are provided in the slide shutter 35. The guide rails 62 are respectively formed on opposite side walls 82 (see FIG. 5) of the mount portion 81 formed on the upper surface portion 80A, the opposite side walls 82 being opposed to each other in the left-right direction 8. The guide rails 62 extend in a direction in which the slide shutter 35 moves (an example of the opening and closing direction), namely in the front-rear direction 7. The guide pieces 64 and 65 are integrally formed with inner surfaces of the guide portion 35C of the slide shutter 35. The guide pieces 64 and 65 are rectangular projections vertically installed on the inner surfaces of the guide portion 35C. Three upper guide pieces 64 are arranged in alignment in the front-rear direction 7 at predetermined intervals on an upper inner surface of the guide portion 35C. Two lower guide pieces 65 are arranged in alignment in the front-rear direction 7 at predetermined intervals on a lower inner surface of the guide portion 35C. That is, the guide pieces 64 and the guide pieces 65 are a plurality of guide pieces that are separate from each other in the up-down direction 6. The guide rails 62 are inserted between the guide pieces 64 and 65. With this configuration, the slide support mechanism 60 can support the slide shutter 35 such that it can move between the second closing position and the second opening position in the front-rear direction 7.

As shown in FIG. 10, each of the guide rails 62 includes a first rail portion 62A on the front side and a second rail portion 62B on the rear side. The first rail portion 62A is configured to be inserted between the guide pieces 64 and 65 when the slide shutter 35 is at the second closing position. In addition, the second rail portion 62B is configured to be inserted between the guide pieces 64 and 65 when the slide shutter 35 is at the second opening position.

In order to secure a smooth slide of the slide shutter 35, the slide shutter 35 is supported by the slide support mechanism 60 with a play in the up-down direction 6 between the guide rails 62 and the guide pieces 64 and 65. In the present embodiment, the first rail portion 62A is formed to be thinner than the second rail portion 62B so that the play (hereinafter, referred to as a closing-side play) that is formed when the slide shutter 35 is disposed at the second closing position, is larger than the play (hereinafter, referred to as an opening-side play) that is formed when the slide shutter 35 is disposed at the second opening position.

In addition, an inclined portion 62C is formed in each of the guide rails 62. The inclined portion 62C is composed of inclined surfaces that are formed on the upper and lower surfaces of the guide rail 62. The inclined portion 62C is formed between the first rail portion 62A and the second rail portion 62B. The inclined portion 62C smoothly guides the guide pieces 64 and 65 from the thin first rail portion 62A to the thick second rail portion 62B when the slide shutter 35 slides from the second closing position to the second opening position. This enables the slide shutter 35 to be moved smoothly.

With the above-described configuration of the slide support mechanism 60, when the slide shutter 35 is at the second closing position, the slide shutter 35 receives a force F10 (see FIG. 10) which is a force of the compressed seal member 38A to restore itself to the original state. As shown in FIG. 10, upon receiving the force F10, the slide shutter 35 is lifted upward by the closing-side play. On the other hand, during the attachment operation in which the toner container 50 is attached to the corresponding attachment position in the container attachment portion 34, the protruding portion 55A abuts on the abutting portion 35B, and a pressing force F20 is applied to the abutting portion 35B. In this case, the pressing force F20 that acts on the slide shutter 35 is divided into a first component force F21 and a second component force F22 during a time period from when the protruding portion 55A abuts on the abutting portion 35B until the toner container 50 is attached to the attachment position, the first component force F21 being directed downward toward the toner receiving ports 38, the second component force F22 being directed in the opening direction toward the second opening position. At this time, the first component force F21 acts so as to compress the seal member 38A (see FIG. 11A). In addition, the second component force F22 acts so as to slide the slide shutter 35 from the second closing position to the second opening position (see FIG. 11B). With this configuration, upon receiving the first component force F21, the slide shutter 35 is displaced downward by the closing-side play and compresses the seal member 38A, and then upon receiving the second component force F22, moves in the opening direction. Here, when the seal member 38A is compressed upon receiving the first component force F21, the toner that had adhered to the inner surface 38B is peeled off from the inner surface 38B. However, the peeled-off toner is not scattered to outside from the toner receiving port 38, but drops downward since the toner receiving port 38 is not opened immediately after the slide shutter 35 is displaced by the closing-side play. In this way, the slide support mechanism 60 of the present embodiment makes it possible to prevent toner that had adhered to the inner surface 38B, from being scattered to outside from the toner receiving port 38 when the slide shutter 35 is opened due to attachment of the toner container 50.

In addition, as described above, since the second rail portion 62B is formed to be thicker than the first rail portion 62A, the opening-side play is smaller than the closing-side play. As a result, when the slide shutter 35 reaches the second opening position, the slide shutter 35 is supported without rattling by the guide pieces 64 and 65 and the second rail portion 62B. Accordingly, it is possible to prevent the slide shutter 35 from being derailed due to rattling with a play, or from being stopped due to inclination in the front-rear direction 7.

Other Embodiments

The above-provided embodiment describes an example case where the slide support mechanism 60 includes the guide rails 62 shown in FIG. 10. However, the slide support mechanism 60 may include guide rails 621 (see FIG. 12A) or guide rails 622 (see FIG. 12B) described below that have different shapes from the above-described guide rails 62. Even when the slide support mechanism 60 includes the guide rails 621 or the guide rails 622, it is possible to prevent toner that had adhered to the inner surface 38B, from being scattered to outside from the toner receiving port 38 when the slide shutter 35 is opened due to attachment of the toner container 50. The guide rails 621 and 622 are described in the following. Here, components that are common to those of the above-described embodiment are assigned the same reference signs, and description thereof is omitted.

Figure 12A:
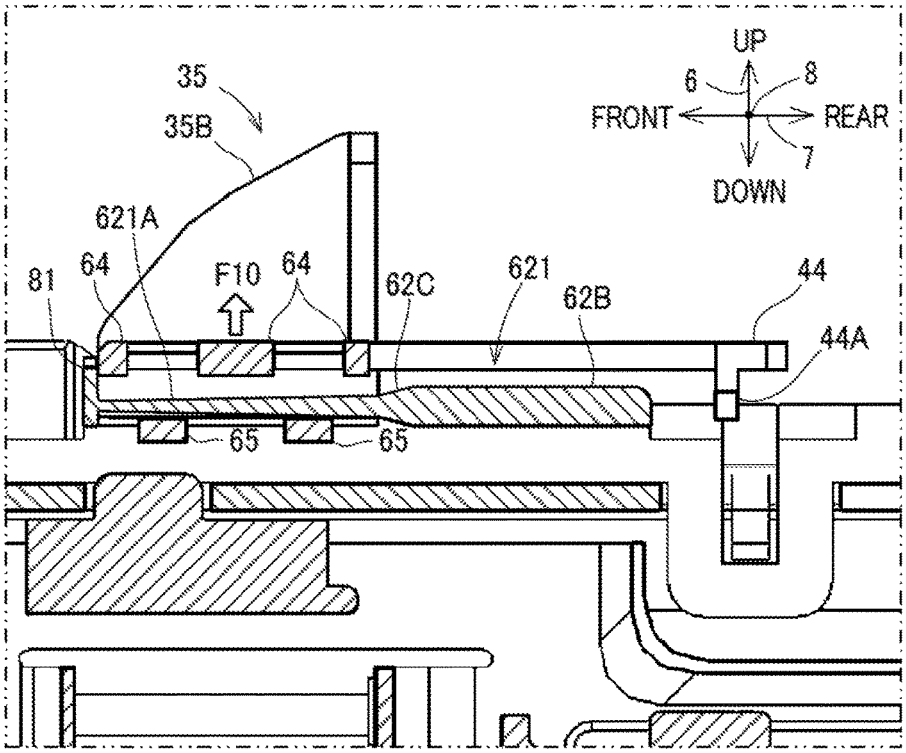
FIG. 12A and FIG. 12B are cross-sectional diagrams showing other examples of the guide rails of the slide support mechanism.

As shown in FIG. 12A, each of the guide rails 621 includes a first rail portion 621A, a second rail portion 621B, and the inclined portion 62C. The first rail portion 621A, as is the case with the above-described first rail portion 62A, is configured to be inserted between the guide pieces 64 and 65 when the slide shutter 35 is at the second closing position. A play in the up-down direction 6 is formed between the guide rails 621 and the guide pieces 64 and 65. Specifically, the first rail portion 621A is formed to be thinner than the second rail portion 621B so that the closing-side play that is formed when the slide shutter 35 is disposed at the second closing position, is larger than the opening-side play that is formed when the slide shutter 35 is disposed at the second opening position. More specifically, the first rail portion 621A is formed in a tapered shape so as to become thinner gradually from the inclined portion 62C to the second closing position.

Figure 12B:
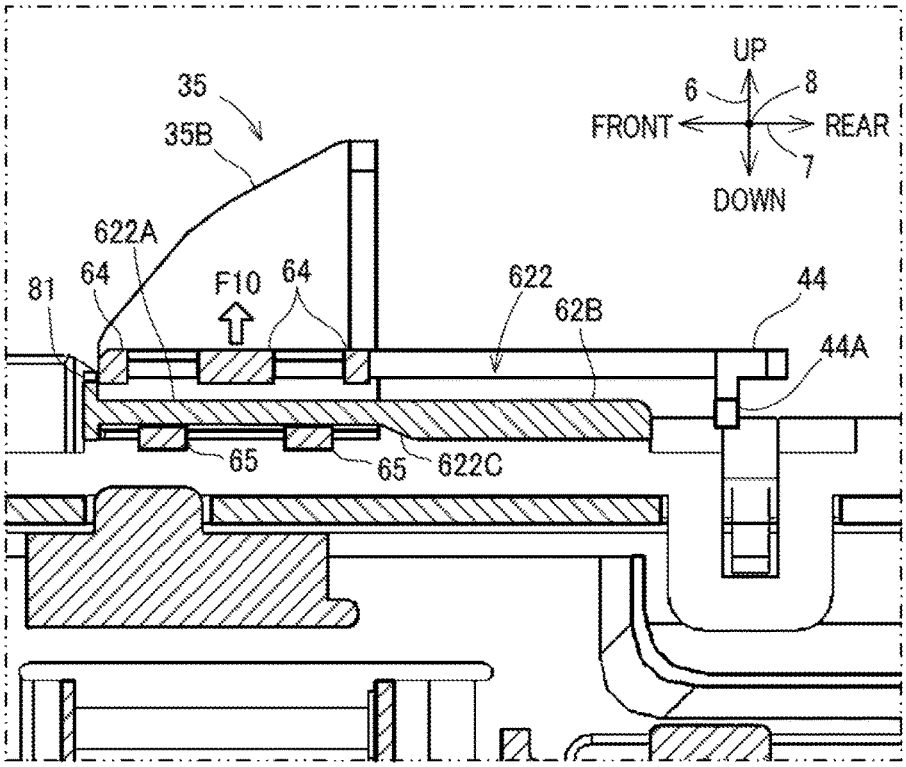

In addition, as shown in FIG. 12B, each of the guide rails 622 includes a first rail portion 622A, the second rail portion 62B, and an inclined portion 622C. The first rail portion 622A is configured to be inserted between the guide pieces 64 and 65 when the slide shutter 35 is at the second closing position. The first rail portion 622A is formed to be thinner than the second rail portion 62B so that the closing-side play that is formed when the slide shutter 35 is disposed at the second closing position, is larger than the opening-side play that is formed when the slide shutter 35 is disposed at the second opening position. More specifically, an upper surface of the first rail portion 622A is a horizontally flat surface that continues to an upper surface of the second rail portion 62B, and a lower surface of the first rail portion 622A is a horizontally flat surface that is higher in position than a lower surface of the second rail portion 62B. The inclined portion 622C is an inclined surface formed on a lower surface of the guide rail 622.

In addition, the above-provided embodiment describes an example case where the tension coil spring 43 that applies an elastic biasing force only in the front-rear direction 7, is attached to the slide shutter 35. However, instead of the above-described tension coil spring 43, a tension coil spring 431 (an example of the elastic member) described below and shown in FIG. 13A and FIG. 13B, may be attached to the slide shutter 35.

In a case where, in order to enhance the sealing performance of the toner receiving port 38, the seal member 38A is provided on the peripheral edge of the toner receiving port, when the slide shutter 35 receives an elastic biasing force and is moved from the second opening position to the second closing position, a front-end lower portion of the slide shutter 35 comes into contact with the seal member 38A, and due to a shock or a vibration of the contact, toner that had adhered to the seal member 38A is scattered. The scattered toner may be scattered to outside from the toner receiving port 38 that is not closed completely. Provision of the tension coil spring 431 can prevent such scattering of toner.

Figure 13A:
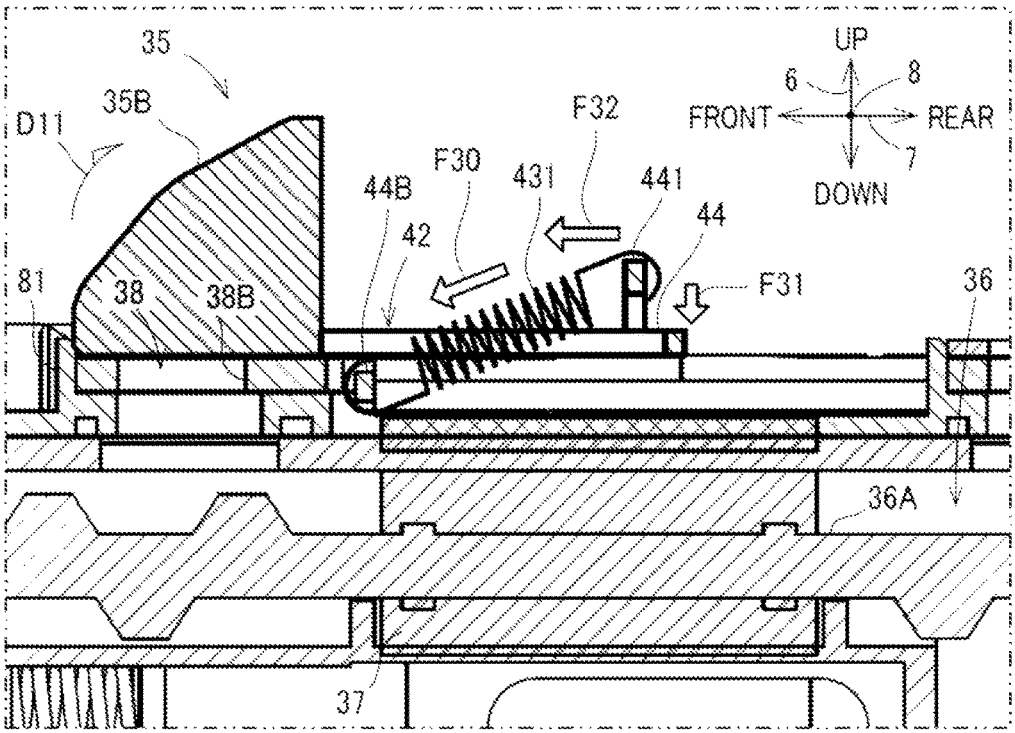
FIG. 13A and FIG. 13B are cross-sectional diagrams showing another example of a tension coil spring.
Figure 13B:
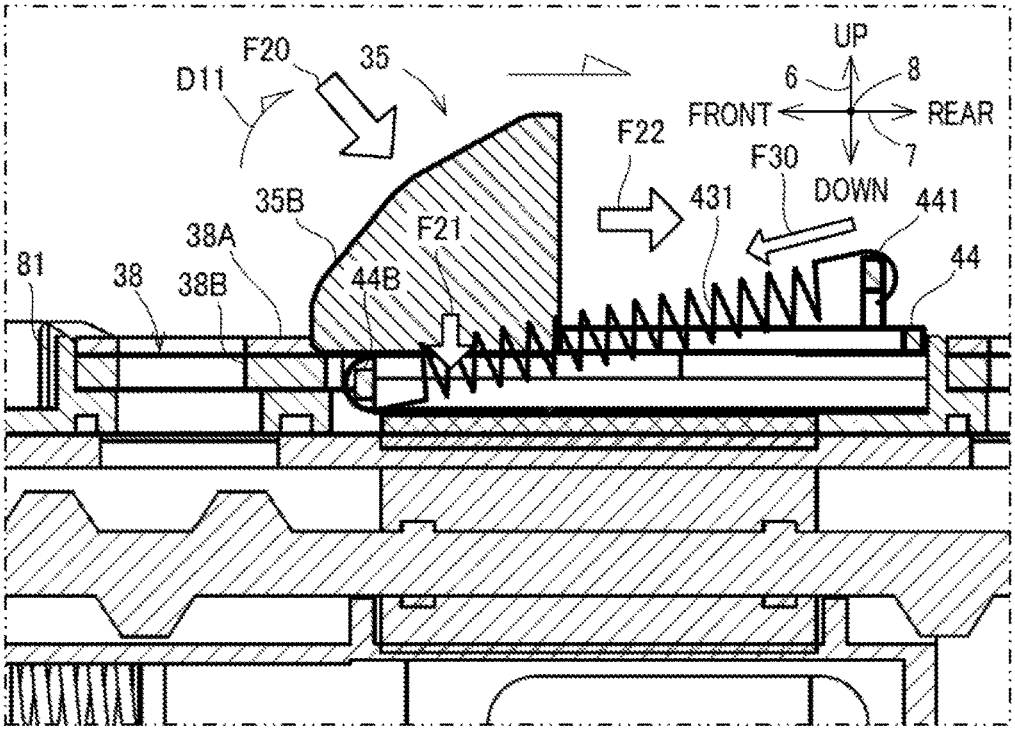

As shown in FIG. 13A, the tension coil spring 431 is attached to the slide shutter 35. The tension coil spring 431 applies a biasing force to the slide shutter 35 in the closing direction in which the slide shutter 35 moves from the second opening position to the second closing position. On the rear end portion 44 of the slide shutter 35 located on the rear side, a projection piece 441 (an example of the locking portion) is formed to project upward from an upper surface of the rear end portion 44. One end of the tension coil spring 431 is attached to an upper end portion of the projection piece 441. The other end of the tension coil spring 431 is attached to the fixed piece 44B that is lower in position than the projection piece 441 and is on the front side (on the second closing position side) of the projection piece 441. In the state where the slide shutter 35 is at the second closing position, the fixed piece 44B stays below the center of the slide shutter 35 in the front-rear direction 7, and more preferably, stays directly below the center of gravity where balance of weight of the slide shutter 35 becomes equal in the front-rear direction 7. With this configuration, as shown in FIG. 13A, the tension coil spring 431 has an attitude of being inclined obliquely downward. In the present embodiment, the inclination degree of the tension coil spring 431 slightly varies depending on which of the second opening position or the second closing position the slide shutter 35 is disposed at, but an attachment position, a natural length and the like are determined such that an inclination angle of the tension coil spring 431 with respect to the horizontal direction is within a range from 10 degrees to less than 30 degrees regardless of the position at which the slide shutter 35 is disposed.

With the tension coil spring 431 attached as described above, in a state where the pressing force F20 is not received, as shown in FIG. 13A, an elastic biasing force F30 is applied to the slide shutter 35, wherein the elastic biasing force F30 is in an inclined direction directed from the projection piece 441 toward the fixed piece 44B, namely, the elastic biasing force F30 is inclined obliquely downward in the closing direction. The elastic biasing force F30 that acts on the slide shutter 35 is divided into a third component force F31 and a fourth component force F32, the third component force F31 being directed downward, the fourth component force F32 being directed in the closing direction (frontward). The third component force F31 biases the slide shutter 35 downward, and the fourth component force F32 biases the slide shutter 35 in the closing direction.

With the above-described configuration, when no external force except for the elastic biasing force F30 from the tension coil spring 431 is applied to the slide shutter 35, the slide shutter 35 keeps to be disposed at the second closing position by the fourth component force F32. In addition, in the state where the slide shutter 35 is disposed at the second closing position, the seal member 38A is pressed downward and compressed by the slide shutter 35. This allows the toner receiving port 38 to keep the sealing performance thereof.

In the above-described configuration where one end of the tension coil spring 431 is attached to a tip of the projection piece 441, and the other end is attached to the fixed piece 44B that is located at the obliquely downward on the front side of the projection piece 441, the fourth component force F32 may act as a rotational force that causes the slide shutter 35 to rotate counterclockwise in FIG. 13A around the fixed piece 44B. However, in the present embodiment, an inclination angle, a spring coefficient, an attachment position, a natural length and the like are determined such that the third component force F31 is always larger than the rotational force regardless of the position of the slide shutter 35. As a result, the third component force F31 that acts on the rear end of the slide shutter 35 always applies, to the slide shutter 35, a force that causes the slide shutter 35 to rotate in a direction indicated by the arrow D11 of FIG. 13A (clockwise), regardless of the position of the slide shutter 35. It is noted that the rotational force becomes small when the fixed piece 44B as the rotation center is disposed on the front side of the position shown in FIG. 13A, and the rotational force is not generated when the fixed piece 44B is disposed on the front side of the slide shutter 35. As a result, the fixed piece 44B is preferably provided below the front end of the slide shutter 35 in the state where the slide shutter 35 is at the second closing position so as to prevent the rotational force from occurring and cause the force in the direction indicated by the arrow D11 of FIG. 13A to occur, even if the force of the spring is weak. In this case, the projection piece 441 is preferably provided on the front side so as to prevent the inclination angle of the developing roller 431 from varying.

When the pressing force F20 is applied to the abutting portion 35B during the attachment operation in which the toner container 50 is attached to the corresponding attachment position in the container attachment portion 34, the downward first component force F21 of the pressing force F20 acts on the slide shutter 35 during the time period since when the protruding portion 55A abuts on the abutting portion 35B until the toner container 50 attaches to the attachment position. This allows the slide shutter 35 to receive the first component force F21, be displaced downward by the closing-side play, and compress the seal member 38A so as to keep high sealing performance, and then receive the second component force F22 and move in the opening direction. At this time, the tension coil spring 431 is further expanded (see FIG. 13B). Here, as described above, when the seal member 38A is compressed upon receiving the first component force F21, the toner that had adhered to the inner surface 38B is peeled off from the inner surface 38B. However, the peeled-off toner is not scattered to outside from the toner receiving port 38, but drops downward since the toner receiving port 38 is not opened immediately after the slide shutter 35 is displaced by the closing-side play.

Figure 14A:
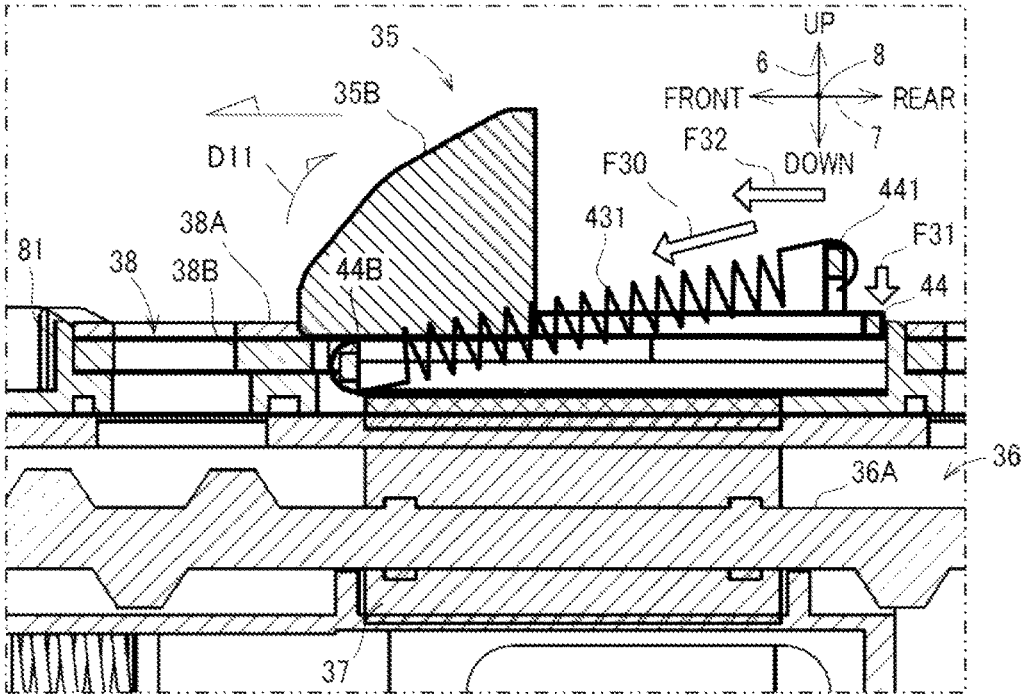
FIG. 14A and FIG. 14B are cross-sectional diagrams showing a further example of the tension coil spring.
Figure 14B:
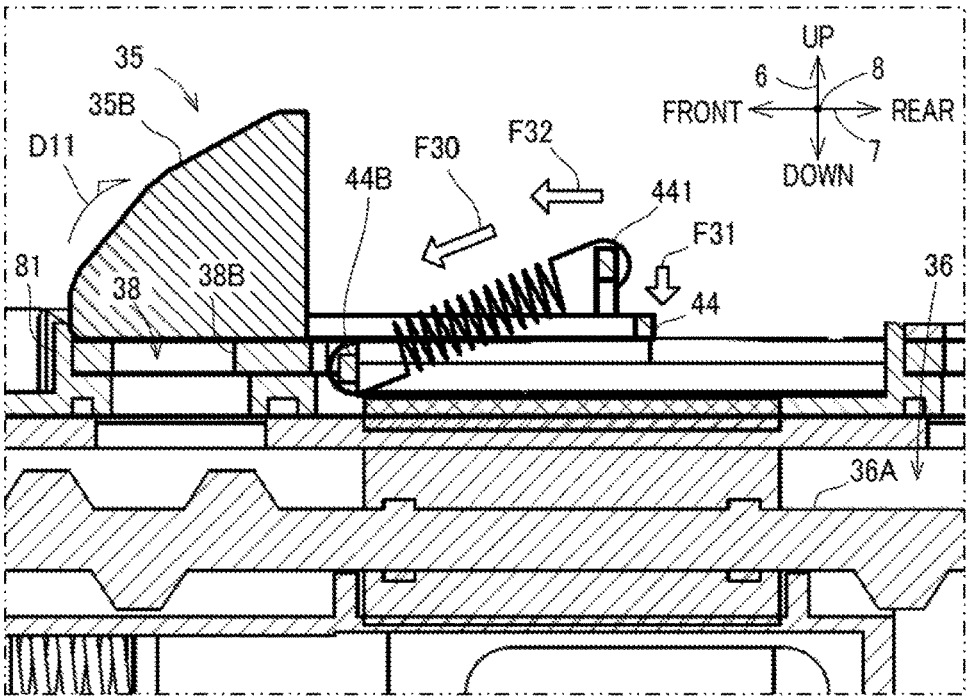

In the state where the slide shutter 35 is disposed at the second opening position as described in FIG. 14A, the elastic biasing force F30 is applied to the slide shutter 35 by the expanded tension coil spring 43, wherein the elastic biasing force F30 at this time is larger than when the slide shutter 35 is disposed at the second closing position. In addition, the fourth component force F32 applied at this time is larger than when the slide shutter 35 is disposed at the second closing position. On the other hand, the third component force F31 applied at this time is the same as that applied when the slide shutter 35 is disposed at the second closing position.

After the toner container 50 is detached, the pressing force F20 is not applied to the slide shutter 35. At this time, the first component force F21 is not also applied to the slide shutter 35 as shown in FIG. 14A. As the downward force, only the third component force F31 is applied. As described above, with the configuration where one end of the tension coil spring 431 is attached to a tip of the projection piece 441, and the other end is attached to the fixed piece 44B that is located at the obliquely downward on the front side of the projection piece 441, the third component force F31 acts as a force that causes the slide shutter 35 to rotate around the fixed piece 44B in a direction indicated by the arrow D11 of FIG. 14A (clockwise). As a result, the front end of the slide shutter 35 is lifted upward by the third component force F31. It is noted that since the guide rails 62 are inserted between the guide pieces 64 and 65, even when the third component force F31 is applied, the front end of the slide shutter 35 is lifted by the opening-side play between the second rail portion 62B and the guide pieces 64 and 65. Accordingly, the slide shutter 35 is closed at once from the second opening position to the second closing position by receiving the fourth component force F32 in the state where the front end is lifted.

Since the slide shutter 35 operates as described above and the toner receiving port 38 is closed, the seal member 38A is compressed while obliquely pressed down by the lower surface of the slide shutter 35. As a result, the force that causes the front end of the slide shutter 35 to come into contact with the seal member 38A is weakened, and shock and vibration are suppressed from being generated when the front end comes into contact with the seal member 38A during the movement of the slide shutter 35 in the closing direction. As a result, the toner that had adhered to the seal member 38A is not scattered, and scattering of the toner to the outside from the toner receiving ports 38 is reduced. In addition, when the slide shutter 35 reaches the second closing position, the slide shutter 35 becomes in close contact with the periphery of the seal member 38A. This makes it possible to close the toner receiving ports 38 while enhancing the sealing performance of the toner receiving ports 38.

In a case where the tension coil spring 431 is provided, the first rail portions 62A need not be provided in the guide rails 62 of the slide support mechanism 60. For example, the guide rails 62 may be rail members that extend in the front-rear direction 7 and have a constant thickness in the up-down direction 6. That is, it suffices that the guide rails 62 are formed to support the slide shutter 35 in such a way as to slide between the second closing position and the second opening position. With this configuration, too, when the toner container 50 is removed, the slide shutter 35 receives the fourth component force F32 in the state where the front end is lifted, and the slide shutter 35 is closed at once from the second opening position to the second closing position. As a result, during the movement in the closing direction, the toner that had adhered to the seal member 38A is not scattered, and scattering of the toner to the outside from the toner receiving ports 38 is reduced.

In addition, the above-provided embodiment describes an example case where the tension coil spring 431 is attached to the fixed piece 44B and the projection piece 441, wherein the fixed piece 44B is provided below the slide shutter 35, and the projection piece 441 is provided on the upper surface of the rear end portion 44 of the slide shutter 35. However, the attachment of the tension coil spring 431 is not limited to this example. For example, the tension coil spring 431 may be attached to a fixed portion (not shown) and a locking portion (not shown), wherein the fixed portion is provided on the front side of the toner receiving ports 38, and the locking portion is provided on an upper portion of the abutting portion 35B. In this case, the fixed portion and the locking portion are preferably provided at positions that are separated from the movement course of the slide shutter 35 in the left-right direction 8 so that the movement of the slide shutter 35 is not obstructed. In addition, in this case, the tension coil spring 431 are preferably provided, one on each of opposite end portions of the slide shutter 35 that are opposed to each other in the left-right direction 8.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner receiving device comprising:

a toner receiving port configured to receive toner supplied from a toner case;

an elastic seal member provided on a peripheral edge of the toner receiving port;

an opening/closing member configured to close and open the toner receiving port by moving between a closing position at which to close the toner receiving port while contacting the seal member and an opening position at which to open the toner receiving port, the opening/closing member moving from the closing position to the opening position in conjunction with an attachment operation in which the toner case is attached to a predetermined attachment position; and a support mechanism including a guide rail and a plurality of guide pieces and supporting the opening/closing member such that the opening/closing member can move between the closing position and the opening position, the guide rail extending in an opening and closing direction of the opening/closing member, and being inserted between the plurality of guide pieces, wherein the guide rail includes:

a first rail portion configured to be inserted between the plurality of guide pieces when the opening/closing member is at the closing position; and a second rail portion configured to be inserted between the plurality of guide pieces when the opening/closing member is at the opening position, and the first rail portion is formed to be thinner than the second rail portion so that a play in an up-down direction between the opening/closing member and the support mechanism is larger when the opening/closing member is at the closing position than when the opening/closing member is at the opening position.

2. The toner receiving device according to claim 1, wherein the opening/closing member includes:

an abutting portion configured to abut on the toner case during the attachment operation of attaching the toner case, and a pressing force is applied to the abutting portion from the toner case during a time period from when the toner case abuts on the abutting portion until the toner case is attached to the attachment position, the pressing force having a first component force and a second component force, the first component force being directed downward toward the toner receiving port, the second component force being directed toward the opening position.

3. The toner receiving device according to claim 2, wherein when the pressing force is applied to the abutting portion, the first component force causes the opening/closing member to be displaced downward by the play so as to compress the seal member, and thereafter, the second component force causes the opening/closing member to move in the opening direction.

4. The toner receiving device according to claim 1, further comprising:

an elastic member configured to apply an elastic biasing force to the opening/closing member, the elastic biasing force being directed in a closing direction in which the opening/closing member moves from the opening position to the closing position.

5. The toner receiving device according to claim 4, wherein the elastic biasing force that is applied from the elastic member to the opening/closing member is obliquely downward in the closing direction.

6. The toner receiving device according to claim 1, wherein the first rail portion is formed in a tapered shape so as to become thinner toward the closing position.

7. The toner receiving device according to claim 1, wherein an upper surface of the first rail portion continues to an upper surface of the second rail portion, and a lower surface of the first rail portion is higher in position than a lower surface of the second rail portion.

8. An image forming apparatus comprising:

the toner receiving device according to claim 1;

an attachment portion to which the toner case is attached at the attachment position; and an image forming portion configured to form an image by using toner supplied to the toner receiving device.

* * * * *